US007762717B2

(12) United States Patent
Röhm et al.

(10) Patent No.: US 7,762,717 B2
(45) Date of Patent: Jul. 27, 2010

(54) DEVICE FOR PROCESSING BULK MATERIALS

(75) Inventors: André Röhm, Affoltern (CH); Ralf Weinekötter, Zürich (CH); Peter Brechbühler, Wettingen (CH); Heinz Diethelm, Hinwil (CH)

(73) Assignee: Gericke AG, Regensdorf (CH)

( * ) Notice: Subject to any disclaimer, the term of this patent is extended or adjusted under 35 U.S.C. 154(b) by 1051 days.

(21) Appl. No.: 11/326,455

(22) Filed: Jan. 6, 2006

(65) Prior Publication Data

US 2006/0175761 A1 Aug. 10, 2006

(30) Foreign Application Priority Data

Jan. 6, 2005 (CH) ..... 0012/05

(51) Int. Cl.
*B01F 7/02* (2006.01)

(52) U.S. Cl. ..... 366/331; 277/412; 277/421

(58) Field of Classification Search ..... 366/331; 277/412, 421

See application file for complete search history.

(56) References Cited

U.S. PATENT DOCUMENTS

| | | | | |
|---|---|---|---|---|
| 1,959,465 | A * | 5/1934 | Dryfoos | 241/69 |
| 2,071,410 | A | 2/1937 | Kuhn et al. | |
| 5,094,542 | A | 3/1992 | Engels et al. | |
| 6,264,360 | B1 | 7/2001 | Lehmusavaara et al. | |

FOREIGN PATENT DOCUMENTS

| | | |
|---|---|---|
| CH | 692 274 | 4/2002 |
| EP | 0 620 039 | 10/1994 |
| FR | 2.218.161 | 9/1974 |

* cited by examiner

*Primary Examiner*—David L Sorkin
(74) *Attorney, Agent, or Firm*—Morgan Lewis & Bockius LLP

(57) ABSTRACT

In a device for processing bulk materials, for example by mixing, shredding, metering and/or screening, with a container (40) and an implement (30) driven therein about a horizontal axis by an external rotary drive (10), it is proposed as claimed in the invention that, arranged between the container (40) and the rotary drive (10), is a connection unit (20), to which the container (40) is detachably fastened, in which a shaft (33) of the implement (30) is detachably retained and is detachably attached to the rotary drive (10), and in which a labyrinth seal (50) is loosely accommodated for the purpose of sealing the container (40) against the implement shaft (33). The device as claimed in the invention is particularly suitable for use in the laboratory and pharmaceuticals sector, where a matter of concern is that the component parts that come into contact with the material to be processed must be capable of being cleaned easily and effectively, and that the delivery and/or discharge of the material can take place inside closed systems, if required. Because of the ease of dismantling of the container (40) and the implement (30), these can also be replaced by differently executed items, and in this way the device as claimed in the invention can also be adapted for different processing tasks. In particular, it is possible to work optionally in batches or continuously.

12 Claims, 5 Drawing Sheets

DEVICE FOR PROCESSING BULK MATERIALS

This application claims the benefit of Swiss patent application no. CH 00012/05 filed Jan. 6, 2005, which is hereby incorporated by reference.

TECHNICAL FIELD

The present invention relates to a device for processing bulk materials, for example by mixing, shredding, metering and/or screening, with a container and an implement therein driven about a horizontal axis by an external rotary drive.

BACKGROUND ART

Devices of this kind are previously disclosed in the widest variety of embodiments. A device executed as a continuous mixer having a horizontal container and an implement therein rotating about a horizontal axis is described, for example, in Swiss patent 692 274. Devices of basically similar construction, but with implements of different forms, are also previously disclosed for the purposes of shredding, metering and/or screening.

The previously disclosed devices of the aforementioned kind are conceived above all for industrial use and are accordingly relatively generously dimensioned, robustly executed and provided with a powerful driving means. An advantage associated with them is the possibility of continuous operation, in conjunction with which the material to be processed can also be delivered and/or discharged via closed pipe systems. Containers and implements are "permanently" installed in these and, as such, are not readily removable, at least by the user. Accordingly, the replacement of implements and, for example, the associated conversion of a mixer into a shredder or a metering machine, are also not readily possible. This is also not required, for the most part, in the context of industrial installations.

A simple and regular solution for the container and the implement of the driving means of the device, in particular for cleaning purposes, tends to be the rule in the case of so-called kitchen machines, on the other hand. Different and mutually interchangeable implements are even supplied with these frequently in the form of a kit. In the case of kitchen machines, the container usually stands vertically, is closed at the bottom, is open towards the top and is capable of being closed with a cover, if necessary. The implement also rotates inside the container about an essentially vertical axis. The vertical orientation of the axis permits a simple solution to the problem of sealing the container in relation to the drive by the formation of baffles and also under the effect of gravity. The vertical orientation also imposes the requirement for processing in charges or batches, rather than continuous processing, the consequence of which is that the material to be processed practically unavoidably comes into contact with the surrounding air. This does not present a problem, however, in the kitchen environment.

DISCLOSURE OF THE INVENTION

The present invention derives from the knowledge that applications exist for the processing of bulk materials, for example by mixing, shredding, metering and/or screening, for which neither the previously described industrial devices nor the kitchen machines are suitably executed. In this case, we are concerned in particular with laboratory applications, in which no large quantities are encountered, but in which, especially in the pharmaceutical sector for instance, the greatest possible demands are imposed on cleanliness, and/or the material for processing, for example due to its extreme toxicity, must not come into contact with the surrounding environment under any circumstances. The object of the invention is accordingly to make available a device that is suitable for such applications.

This object is achieved in accordance with the invention by the characterizing features indicated in the patent claims.

At its core, therefore, in a device of the aforementioned kind, the invention provides for the arrangement between the container and the rotary drive of a connection unit, to which the container is detachably fastened, in which a shaft of the implement is detachably retained and is detachably attached to the rotary drive, and in which a labyrinth seal is loosely accommodated for the purpose of sealing the container against the implement shaft.

The expression "detachably fastened" is used here to denote a fastening of a kind that is detachable with a few movements of the hand and without the need for special tools, as required by the regulations and without damage, and is then capable of being reassembled without major difficulties. The expression "loosely accommodated" should be understood to denote, with reference to the labyrinth seal, that this is not installed and secured in a complicated fashion in the connection unit, but is capable of being inserted into it and removed from it more or less with a single movement of the hand.

The benefits achieved through the invention can be appreciated above all from the fact that the implement and the container, and with them the labyrinth seal, are easily removable and, as such, are also capable of being cleaned easily and individually in each case. In contrast to the previously disclosed industrial devices, in which lip seals or the like are customarily used for the purpose of sealing, the labyrinth seal utilized in accordance with the invention permits the simple insertion and withdrawal of the shaft of the implement without the associated risk of damage to the seal. Because of the ease of dismantling of the implement, different, mutually interchangeable implements can also be used for different processing tasks. Thanks to the horizontal arrangement of the axis of the implement, the container can easily be filled from above and emptied towards the bottom. Thanks to the horizontal arrangement of the axis of the implement, operation other than in batches is also possible continuously as an option. The container and the entire system for the delivery and discharging of the material for processing can be of hermetically sealed execution, so that the material is not able to come into contact with the surroundings. Thanks to the connection of the shaft of the implement to the rotary drive in the connection unit, and thereby outside the container, essentially its entire volume is available as processing chamber. The fact that the labyrinth seal is accommodated loosely in the connection unit and is capable of being dismantled from this, means that it can be inspected and cleaned externally. Because it does not require any elastic component parts, such as lip seals, that are also subject to abrasion, and since the container and the implement can consist in their entirety of a metallic material, for example, cleaning is very effective. Furthermore, it could accordingly also be sterilized in an autoclave at a high temperature (e.g. 130° C.) together with the container and the implement. Hygienic conditions can be stipulated, assured and also demonstrated in this way for all parts of the device that come into contact with the material for processing, which is required above all for pharmaceutical applications. The labyrinth seal in this case constitutes the separating element between the hygienic part of the device and the driving part of the device, in relation to which no such strict requirements are imposed in respect of cleanliness.

In a first, preferred embodiment, the connection unit exhibits an external casing, to which the container is detachably flange-mounted. According to a further, preferred embodiment, the shaft of the implement is detachably attached in the connection unit with a spigot of the rotary drive via a receiving socket.

The presence of an external casing permits the receiving socket to be supported in the casing preferably in the vicinity of its end close to the container.

To the extent that the shaft of the implement is retained in the receiving socket with such lateral stability that the implement does not require any further means of support beyond that already provided, the implement can terminate freely in the container. A further means of support, such as a bearing situated close to the end, does not require to be dismantled in this case for the purpose of removing the implement. The absence of a further means of support also enables cleaning of the device to be carried out more easily and more rapidly.

According to a further, preferred embodiment, the shaft of the implement is secured in only non-positive engagement in the receiving socket in the axial direction. All that is required in this case for assembling the implement is to insert the implement with its shaft through the labyrinth seal and into the receiving socket. Conversely, the implement can be withdrawn simply from the receiving socket for the purpose of dismantling it, without the need to undo any screwed connections or the like.

A particularly simple construction results if the spigot of the rotary drive is mounted in the rotary drive. All that is required in this case, in order to retain the implement in its entirety in the receiving socket in a sufficiently stable fashion, is to provide the aforementioned support for the receiving socket in the casing of the connection unit.

The labyrinth seal provided for the purpose of sealing the container against the shaft of the implement exhibits the advantage that, because of its oversize, the shaft of the implement can be readily inserted through it or withdrawn from it, without the need for manipulations of any kind to be performed on it. In order further to seal the gap that is present due to the oversize against the bulk material to be processed in the container, the labyrinth seal can also be subjected to pressure with a flushing gas in the direction of the container.

Among other things, in order to facilitate access to the implement and its assembly or disassembly, the container can be provided with a removable front cover on its side facing away from the rotary drive.

According to a further, preferred embodiment, the container exhibits an upper inlet opening and a lower outlet opening, of which at least one is capable of being closed preferably in a sealing fashion by means of at least one sealing element in relation to the bulk materials for processing. At least one of these openings can also be executed in such a way that a pipe can be connected to it.

In contrast to the above-mentioned devices for industrial use, the device in accordance with the invention is preferably dimensioned in such a way that the container exhibits a volume of between 0.1 and 100 liters, and in particular between 1 and 10 liters. The rotary drive can be designed for a maximum torque in the range between 0.1 and 300 Nm.

BRIEF DESCRIPTION OF THE DRAWINGS

The invention is now described below in greater detail in the form of illustrative embodiments with reference to the drawing. The following are shown in the figures.

Corresponding component parts are identified in the figures with identical reference designations.

MODES FOR CARRYING OUT THE INVENTION

Figure 1:
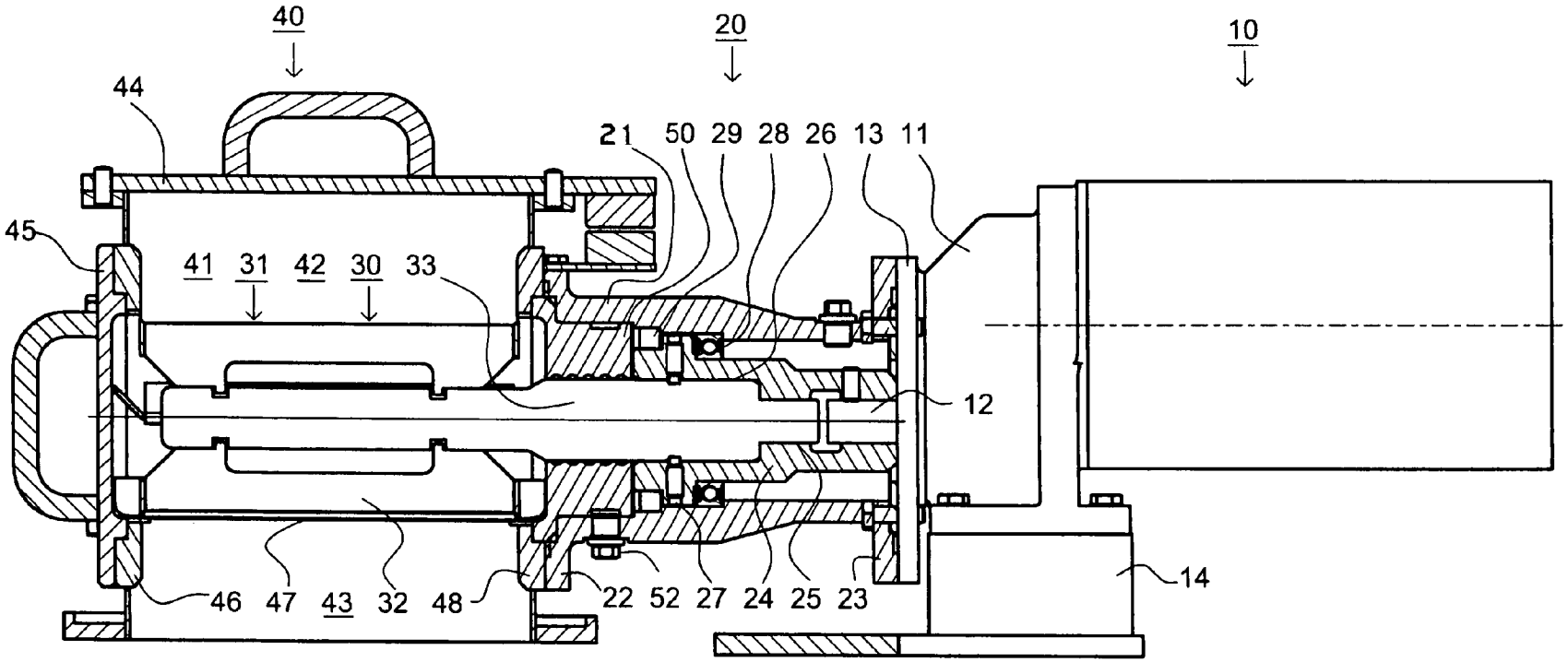
FIG. 1 in a partially sectioned representation, a first embodiment of a device in accordance with the invention in an execution intended for shredding a bulk material.

FIG. 1 shows a first embodiment of a device in accordance with the invention in a partially sectioned representation. The device comprises a rotary drive 10, a connection unit 20, an implement 30 and a container 40.

The rotary drive 10 is, for example, a spur wheel back-geared motor with an integral transmission 11. The reference designation 12 denotes a drive spigot of the rotary drive 10 and the transmission 11 projecting into the connection unit 20, and reference designation 13 denotes a transmission flange. The rotary drive is secured in a fixed position in a holding device 14.

The container 40 encloses a processing chamber 41 and exhibits an upper inlet opening 42 and a lower outlet opening 43. The inlet opening 42 is closed by means of a removable cover 44. A further cover 45 is flange-mounted on a free end wall 46 of the container 40 and closes an opening that is present there. The diameter of this opening corresponds approximately to the diameter of the processing chamber. The processing chamber is delimited by a grating 47 in the direction of the outlet opening. A collecting container (not illustrated here) can be positioned under the outlet opening 43.

The implement 30 in FIG. 1 comprises an implement head 31 provided and adapted for the purpose of shredding a bulk material with a plurality of paddles or beater bars 32 and an implement shaft 33. The implement head 31 with its paddles or beater bars 32 is fitted in the processing chamber 41 of the container 40 and is capable of rotating therein about a horizontal shaft. The implement head 31 is retained and supported solely by means of the implement shaft 33 outside the container 40. The implement shaft 33 is introduced for this purpose through an opening in the end wall 48 of the container 40 close to the rotary drive and extends into the connection unit 20. This opening also exhibits a diameter which corresponds approximately to the diameter of the processing chamber 41.

The connection unit 20 exhibits a rotationally symmetrical, more or less lantern-shaped outer casing 21, which is provided with bilateral flanges 22 and 23. The casing 21 is bolted to the aforementioned transmission flange 13 via the flange 22, and to the end wall 48 of the container 40 via the flange 23.

The implement shaft 33 is rigidly attached to the drive spigot 12 of the rotary drive 10 in the connection unit 20 and the casing 21 via a similarly rotationally symmetrical receiving socket 24. For this purpose, both the drive spigot 12 and an end section 34 (see FIG. 3*b*)) of the implement shaft 33 are provided with a polygonal cross section and are inserted from opposite directions into a corresponding recess 25 executed with polygonal form on the end of the receiving socket 24 close to the driving means. A section 35 (see FIG. 3*b*)) of the implement shaft 33 with an enlarged diameter is provided with a round cross section, on the other hand, and is fitted essentially without any free play into a recess 26, also with a round cross section, at the end of the receiving socket 24 close to the container. The receiving socket 24 is secured to the drive spigot 12 in the axial direction, for example in positive engagement with a setscrew. The implement shaft 33, on the other hand, is secured in only non-positive engagement to the receiving socket 24 in the axial direction and, to be precise, via spring-assisted thrust pads 27, which engage in the implement shaft 33 with a groove 36 (see FIG. 3*b*)) provided with an inclined flank. In this way, the implement shaft 33 can be withdrawn easily from the receiving socket 24 by the application of a certain level of tractive force.

The receiving socket 24 is supported by a deep-groove ball bearing 28 in the outer casing 21 of the connection unit 20. At least one additional bearing is also present in the transmission 11 of the rotary drive 10 for the drive spigot 12, although this is not illustrated in the figures as a standard component of the transmission. The implement 30 is not provided with any additional support other than via these bearings. In particular, its end close to the container is not provided with additional support and is free. The receiving socket 24 is sealed by means of a lip seal 29 in relation to the casing 21.

For the purpose of sealing the end wall 48 of the container 40 against the implement shaft 33, a labyrinth seal 50 is inserted with a perfect fit, although still loosely, into the casing 21 from its end close to the container. With its peripheral edge 51, the labyrinth seal 50 makes contact with a corresponding step in the casing 21 and is also retained in position by the end wall 48. As suggested by its name, the labyrinth seal 50 is oversized in relation to the implement shaft 33 and, in particular, in relation to the section 35 of the implement shaft 33 with its enlarged diameter. The implement shaft 33 is capable in this way of being introduced unimpeded through the labyrinth seal 50 into the connection unit 20 and inserted into the receiving socket 24. In precisely the same way, it can again be withdrawn unimpeded through the labyrinth seal 50 from the connection unit 20 and the receiving socket 24.

In order to ensure that no material is able to penetrate from the container 40 into the gap to be sealed, the gap can be flushed in the opposite direction with a gas, which is supplied under pressure via a flushing gas connection 52. Because of the aforementioned snug fit of the implement shaft 33 in the receiving socket 24, and of the aforementioned lip seal 29 between the receiving socket 24 and the casing 21, the flushing gas is unable to take a path other than through the gap in the labyrinth seal into the container 40.

Seals in the form of o-rings or the like are also provided at other interfaces in the device, in particular between the flange 22 of the connection unit 20 and the transmission flange 13 and the flange 23 of the connection unit 20 and the end wall 48 of the container 40. Only the sealing grooves required for these seals are illustrated in the figures.

Figure 2:
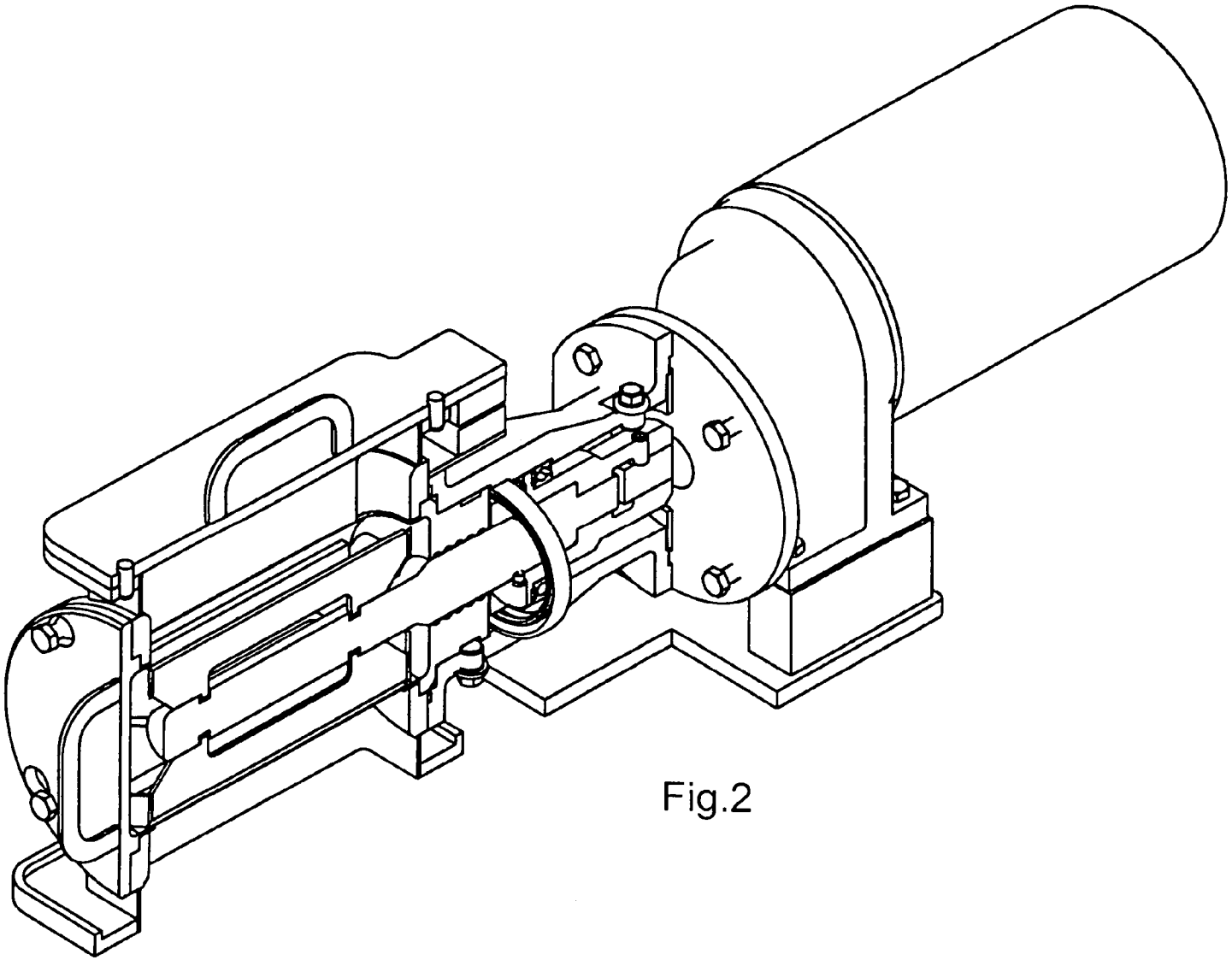
FIG. 2 the device in FIG. 1 in a partially halved, perspective representation.

The previously described embodiment is further clarified by the perspective representation in FIG. 2.

Figure 3A:
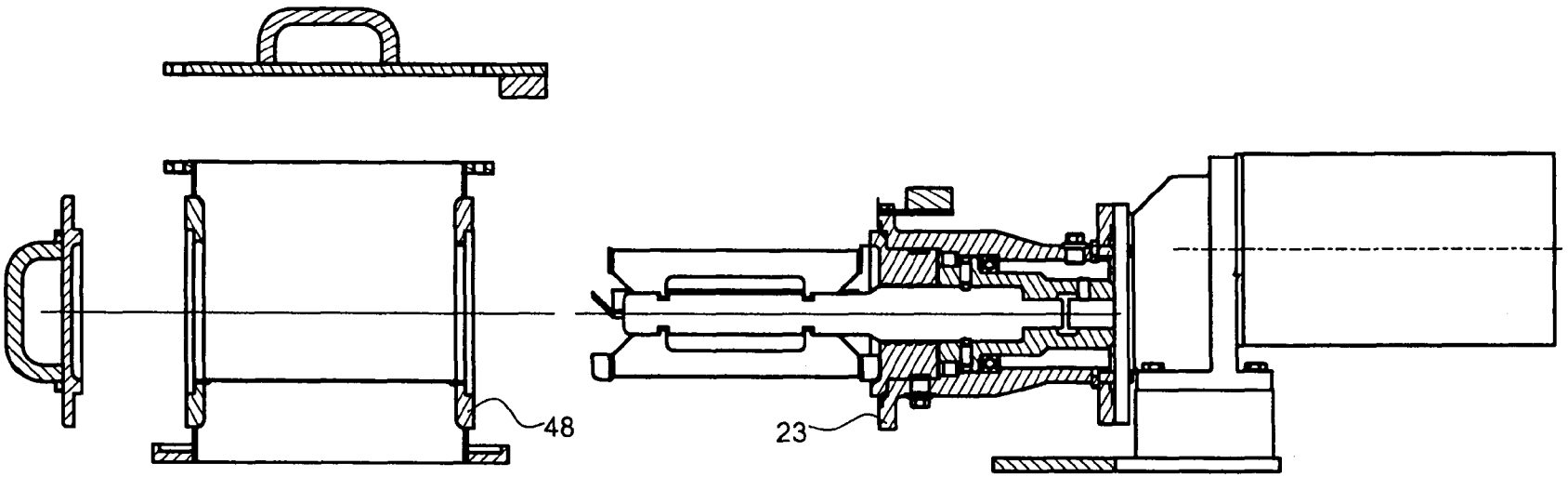
FIG. 3 under a) and b), in partially sectioned exploded representations, the steps for the partial dismantling of the device in FIG. 1.

In the previously described device in accordance with the invention, the component parts or constructional units which come into contact with the material for processing are capable of being dismantled easily, for example for cleaning purposes. The necessary steps should be appreciated below with reference to FIG. 3:

For example, the two covers 44 and 45 are first removed from the container 40. The flanged connection 48/23 between the container 40 and the connection unit 20 is then parted. Since the implement 30 is retained and supported solely in the connection unit 20, and projects into the container 40 only with its implement head 31, and since the diameter of the opening in the wall 48 of the container corresponds more or less to the diameter of the processing chamber 41, the container 40 can then be pulled off easily to one side. The resulting situation is illustrated in FIG. 3*a*).

Figure 3B:
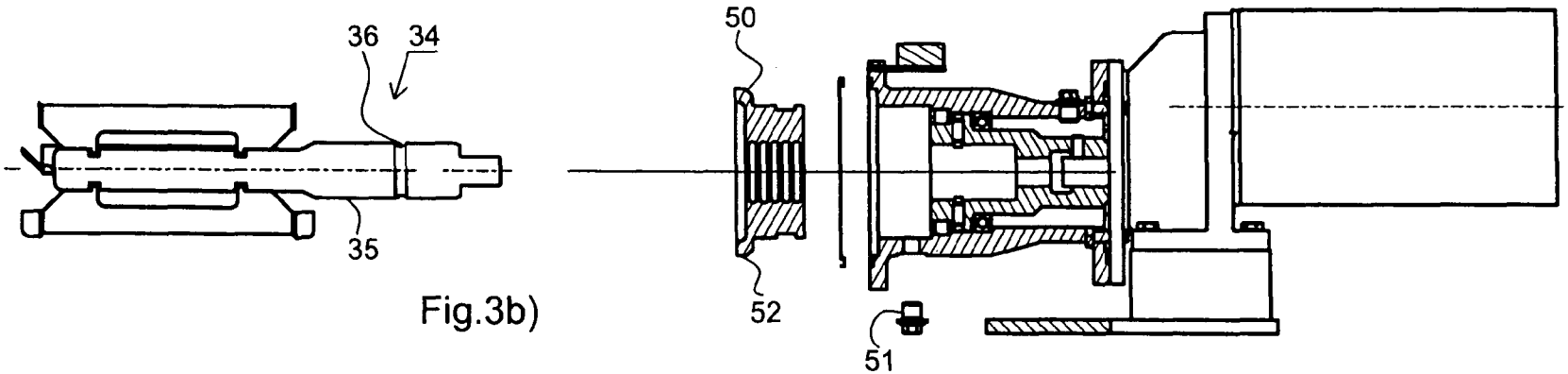

As illustrated in FIG. 3*b*), the implement 30 can then be withdrawn from the connection unit 20, into which it is admittedly only inserted. As outlined above, the labyrinth seal 50 does not present any obstruction in connection with this. Finally, the labyrinth seal 50 can also be removed from the connection unit 20.

Assembly of the individual component parts takes place in the reverse order.

It is possible at this time to replace individual dismantled component parts by replacement parts, but also by differently executed component parts, and in this way to adapt the device in accordance with the invention for a different processing task. Four further devices in accordance with the invention are illustrated in FIGS. 4-7 for the purpose of explaining these opportunities for variation. Represented in each case in FIGS. 4-7 are the same rotary drive 10 with the same connection unit 20, which are combined with differently executed containers 40, in which other implements can be used in each case. An implement 30 of this kind is represented with broken lines in the container 40 in FIG. 4.

Figure 4:
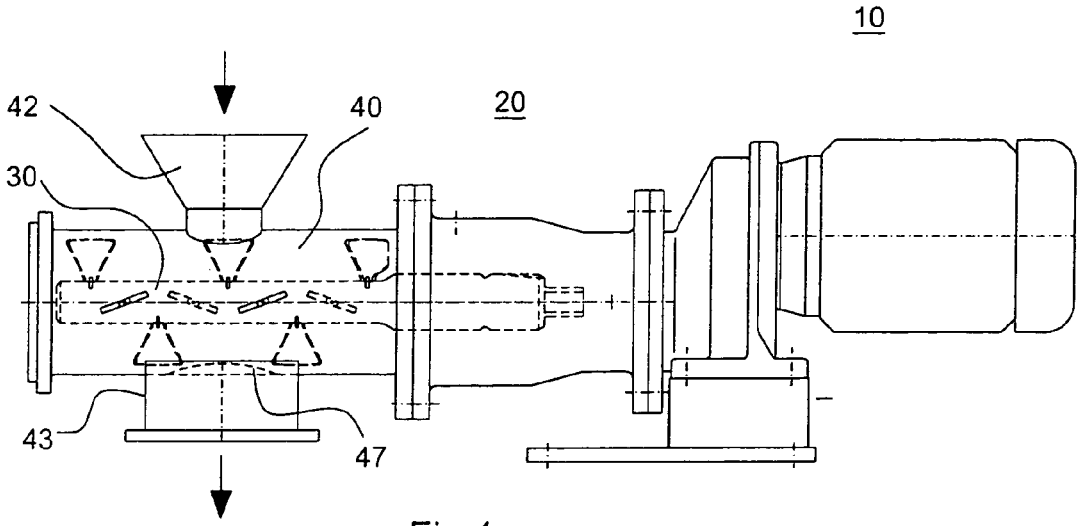
FIG. 4 a second embodiment of a device in accordance with the invention in an execution intended as a batch mixer.

FIG. 4 shows a device in accordance with the invention in an embodiment as a batch mixer and charge mixer. The container 60 in this case is provided with a hopper-shaped inlet opening and an outlet opening 43 arranged vertically beneath this. The outlet opening 43 is capable of being closed during the mixing process by means of a flap 47' represented with broken lines.

Figure 5:
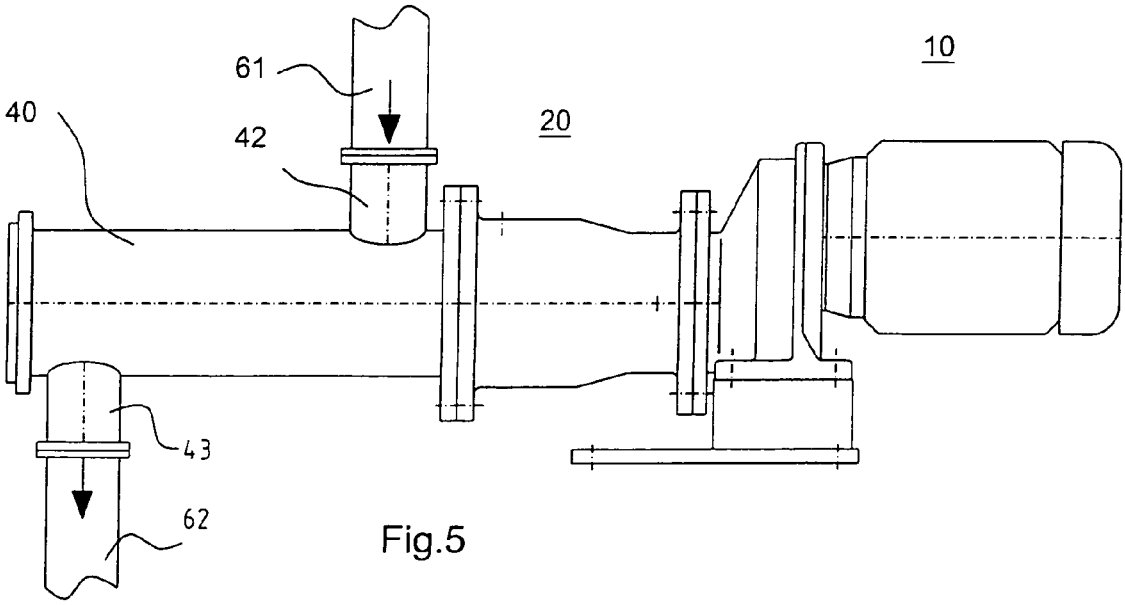
FIG. 5 a third embodiment of a device in accordance with the invention in an execution intended as a continuous mixer with attached pipes for the delivery and discharging of the mixed material.

The device in FIG. 5 is a continuous mixer, in which the material to be mixed in the container 40 is transported during the mixing process by the appropriate execution of the mixing implement 30, also represented by broken lines, from the inlet opening 42 arranged above its end close to the driving means to the outlet opening 43 arranged below its opposite end.

FIG. 5 also illustrates by way of example, by means of pipes 61 and 62 flange-mounted to the inlet opening 42 and the outlet opening 43, how the device can be integrated, if necessary, into a closed system for the delivery and discharge of the material for processing. Corresponding pipes could basically be provided for the other embodiments.

Figure 6:
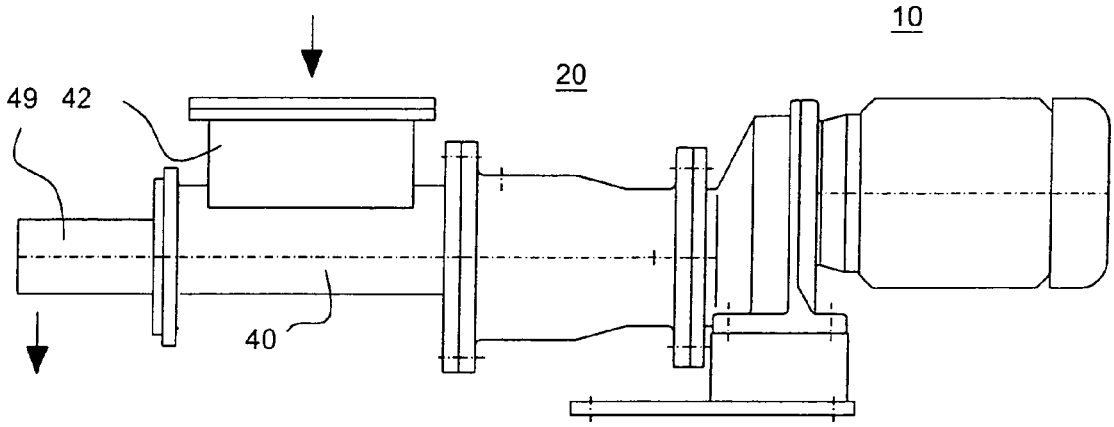
FIG. 6 a fourth embodiment of a device in accordance with the invention in an execution intended as a metering machine.

FIG. 6 shows a device in accordance with the invention in an embodiment as a metering machine, in which the implement is executed as a metering spiral or a metering screw. This transports a uniform flow of a bulk material, which can be adjusted by variation of its frequency of rotation, into a horizontal tubular sleeve 49 flange-mounted on the container 40 in place of the cover 45 shown in FIG. 1, into the end of which sleeve the bulk material is ejected.

Figure 7:
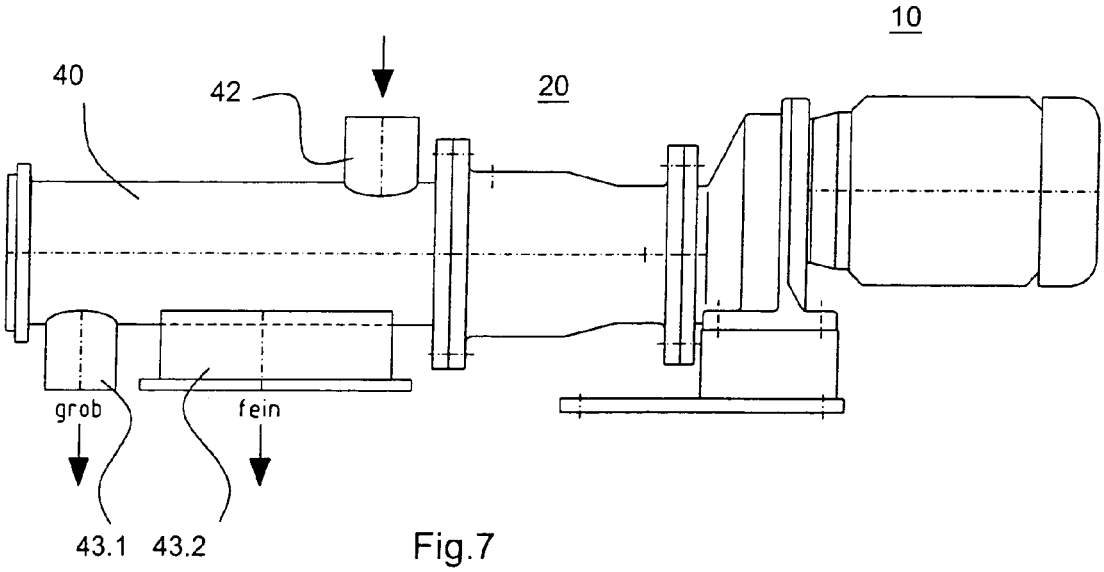
FIG. 7 a fifth embodiment of a device in accordance with the invention in an execution suitable for screening.

The device illustrated in FIG. 7 is executed for screening. A bulk material with a different grain size is fed into the container via the inlet opening 42. A finer fraction of this bulk material exits from the container 40 via the outlet opening 43.1, and a coarser fraction exits via the outlet opening 43.2.

LIST OF REFERENCE DESIGNATIONS

10 rotary drive
11 transmission
12 drive spigot
13 transmission flange
14 holding device
20 connection unit
21 outer casing of the connection unit
22 casing flange
23 casing flange
24 receiving socket
25 polygonal recess in the receiving socket
26 round recess in the receiving socket
27 spring-assisted thrust pad
28 deep-groove ball bearing
29 lip seal
30 implement
31 implement head
32 paddle or beater bar
33 implement shaft
34 end section of implement shaft
35 section of the implement shaft
36 groove in the implement shaft
40 container
41 processing chamber
42 upper inlet opening
43 lower outlet opening
44 cover
45 cover
46 end wall of the container
47 grating
47' flap
48 end wall of the container close to the driving means
49 tubular sleeve
50 labyrinth seal
51 edge of the labyrinth seal
52 flushing gas connection
61 pipe
62 pipe

The invention claimed is:

1. Device for processing bulk materials, for example by mixing, shredding, metering and/or screening, said device comprising: a container, an implement, a shaft of the implement, an external rotary drive, a connection unit, and a labyrinth seal;

wherein the implement is driven within the container about a horizontal axis by the external rotary drive, wherein the connection unit is arranged between the container and the rotary drive, wherein the container is detachably fastened to the connection unit, wherein the shaft of the implement is detachably retained in the connection unit and detachably attached to the rotary drive, wherein the labyrinth seal is loosely accommodated in the connection unit for the purpose of sealing the container against the implement shaft of the implement, wherein the labyrinth seal is oversized with respect to the shaft providing a gap between the labyrinth seal and the shaft, wherein the implement shaft is detachably attached in the connection unit with a spigot of the rotary drive, and wherein the implement shaft is retained only in the connection unit and terminates freely in the container.

2. Device as claimed in claim 1, wherein the connection unit exhibits an outer casing, to which the container is detachably attached by flange-mounting.

3. Device as claimed in claim 2, wherein the implement shaft is detachably attached in the connection unit with a spigot of the rotary drive via a receiving socket.

4. Device as claimed in claim 3, wherein the receiving socket is supported in the casing in the area of its end close to the container.

5. Device as claimed in claim 3, wherein the implement shaft is secured in only non-positive engagement in the receiving socket in the axial direction.

6. Device as claimed in claim 3, wherein the spigot of the rotary drive is supported in the rotary drive.

7. Device as claimed in claim 1, wherein the labyrinth seal can be flushed with a flushing gas in the direction of the container.

8. Device as claimed in claim 1, wherein the container exhibits a removable front cover on its side facing away from the rotary drive.

9. Device as claimed in claim 1, wherein the container exhibits an upper inlet opening and a lower outlet opening, of which at least one is capable of being closed by means of at least one sealing element in relation to the bulk materials for processing.

10. Device as claimed in claim 1, wherein the container exhibits an upper inlet opening and a lower outlet opening, of which at least one is capable of being connected to at least one pipe.

11. Device as claimed in claim 1, wherein the container exhibits a volume of between 0.1 and 100 liters.

12. Device as claimed in claim 1, wherein the container exhibits a volume of between 1 and 10 liters.

* * * * *